United States Patent [19]

Heitmann et al.

[11] Patent Number: 4,744,711

[45] Date of Patent: May 17, 1988

[54] BOBBIN CHANGING APPARATUS FOR USE IN TOBACCO PROCESSING MACHINES

[75] Inventors: Bob Heitmann, Hamburg; Wolfgang Steiniger, Börnsen; Peter Schumacher, Hamburg, all of Fed. Rep. of Germany

[73] Assignee: Körber AG, Hamburg, Fed. Rep. of Germany

[21] Appl. No.: 796,563

[22] Filed: Nov. 8, 1985

[30] Foreign Application Priority Data

Nov. 16, 1984 [DE] Fed. Rep. of Germany ..... 3441872
Sep. 30, 1985 [DE] Fed. Rep. of Germany ..... 3534771

[51] Int. Cl.[4] ..... B65H 19/00

[52] U.S. Cl. ..... 414/120; 242/58; 242/58.6; 269/47; 294/113; 414/590; 414/620; 414/728; 414/729; 414/911

[58] Field of Search ..... 269/34, 47; 279/2 A, 279/106; 294/31.1, 86.26, 113, 114, 97, 100, 106; 414/27, 113, 120, 225, 728, 738, 911, 910, 590, 729, 620; 242/58, 58.6, 79

[56] References Cited

U.S. PATENT DOCUMENTS

| | | | |
|---|---|---|---|
| 3,022,551 | 2/1962 | Marburg | 294/97 X |
| 3,128,118 | 4/1964 | Ezzell | 294/97 |
| 4,195,961 | 4/1980 | Waiblinger | 414/120 |
| 4,199,183 | 4/1980 | Hecker | 294/97 |
| 4,312,618 | 1/1982 | Greene | 414/225 |
| 4,441,662 | 4/1984 | Seragnoli | 242/58 |
| 4,484,716 | 11/1984 | Korcusko et al. | 242/79 |
| 4,596,505 | 6/1986 | Seelinger | 414/911 X |
| 4,614,075 | 9/1986 | Focke et al. | 242/58 X |

FOREIGN PATENT DOCUMENTS

| | | | |
|---|---|---|---|
| 2951094 | 7/1981 | Fed. Rep. of Germany | 294/113 |
| 2066789 | 7/1981 | United Kingdom . | |
| 969358 | 11/1982 | U.S.S.R. | 242/79 |

*Primary Examiner*—Frank E. Werner
*Assistant Examiner*—Janice Krizek
*Attorney, Agent, or Firm*—Peter K. Kontler

[57] ABSTRACT

Apparatus for automatically transferring successive fresh bobbins from a magazine wherein the bobbins are stacked in horizontal planes to one of two reciprocable horizontal spindles which are carried by a pivotable holder has annular tongs with claws which are movable into engagement with the periphery of the topmost bobbin in the magazine, and a crank drive which changes the orientation of tongs during transport between the magazine and an unoccupied spindle so that a fresh bobbin which is engaged by the claws in the magazine is moved from its horizontal plane into a vertical plane and its core can receive the unoccupied spindle.

22 Claims, 7 Drawing Sheets

BOBBIN CHANGING APPARATUS FOR USE IN TOBACCO PROCESSING MACHINES

BACKGROUND OF THE INVENTION

The invention relates to improvements in apparatus for manipulating bobbins or reels wherein a core supports a convoluted web of wrapping material or the like. More specifically, the invention relates to improvements in apparatus for manipulating bobbins of wrapping material which can be used with advantage in machines of the tobacco processing industry, such as cigarette making, filter tipping or filter rod making machines. Still more particularly, the invention relates to improvements in apparatus which can be provided with an indexible or otherwise movable support for bobbins of convoluted cigarette paper webs or the like and wherein the support comprises an indexible holder for two spindles one of which can support a fresh bobbin while the other spindle supports an expiring bobbin, i.e., a bobbin from which the web is being advanced to the web consuming station of a cigarette making or other machine. Apparatus to which the present invention pertains can be utilized with particular advantage in rod making machines, such as machines for the mass production of plain cigarettes or filter rod sections of unit length or multiple unit length.

The operation of modern production lines for the making of plain or filter tipped cigarettes, cigars, cigarillos and like rod-shaped smokers' articles is highly automated so that the production lines can turn out immense quantities of rod-shaped articles per unit of time. In such production lines, the bobbins of wrapping material (such as cigarette paper, tipping paper or wrapping material for the filamentary or other fillers of filter rods) must be replaced at frequent intervals and the duration of each exchange must be held to a minimum because even a very short-lasting interruption of operation of a mass-producing machine (such as a cigarette rod making machine which turns out up to and in excess of 8000 plain cigarettes per minute) can entail substantial losses in output.

It is already known to provide a cigarette maker with an apparatus which is designed to automatically or semiautomatically replace expired bobbins of cigarette paper or the like with fresh bobbins. Automatic replacement of expired bobbins is highly desirable because such operation is one of the very few which are not fully automated in many existing cigarette making and like machines of the tobacco processing industry. For example, U.S. Pat. No. 4,441,662 to Seragnoli proposes to supply successive fresh bobbins of cigarette paper to a station where such bobbins are taken over by a transfer unit and delivered to the spindle of a support whence the web of the freshly delivered bobbin is supplied to the consuming station of the utilizing machine. A supply of fresh bobbins is stored in a downwardly sloping trough and the transfer unit is reciprocable along an elongated track which is disposed at the lower end of the trough. The bobbins in the trough are held in substantially vertical planes and the spindle which receives successive fresh bobbins is mounted for rotation about a horizontal axis so that the orientation of a bobbin during transport from the trough to the spindle need not be changed at all or requires only a minor change. A drawback of such apparatus is that the foremost bobbin of the supply of fresh bobbins in the trough must be transported along an elongated path which is undesirable in modern production lines wherein the space is at a premium.

British Pat. No. 2 066 789 to Filter et al. discloses a modified bobbin manipulating apparatus wherein fresh bobbins are also stored in the form of a horizontal stack (i.e., in vertical planes) and must be transported along a relatively long path before they reach the empty spindle of the bobbin support in the consuming machine. The apparatus of the British patent further comprises devices which compensate for deviations of the diameters of fresh bobbins from a standard diameter. Such deviations are attributable mainly to automatic deformation of bobbins which are stored in vertical planes.

OBJECTS AND SUMMARY OF THE INVENTION

An object of the invention is to provide a novel and improved apparatus for manipulating bobbins which contain convoluted webs of cigarette paper, tipping paper or like flexible material in such a way that the webs and/or bobbins are not defaced and/or deformed during storage and/or during transfer to the consuming station.

Another object of the invention is to provide a highly compact apparatus wherein the bobbins are manipulated gently and must cover short distances on their way from storage to the locale of use.

A further object of the invention is to provide a novel and improved magazine for storage of bobbins adjacent to a consuming machine.

An additional object of the invention is to provide novel and improved means for supporting fresh and expiring bobbins in a processing or consuming machine.

Still another object of the invention is to provide the apparatus with novel and improved means for transferring fresh bobbins from the magazine to the supporting means.

A further object of the invention is to provide a novel and improved production line including a machine which consumes webs of convoluted cigarette paper or the like and an apparatus which automatically supplies fresh bobbins to the bobbin supporting means of such machine.

An additional object of the invention is to provide the apparatus with novel and improved means for eliminating deformations of bobbins in the course of their transfer to the consuming or processing machine.

A further object of the invention is to provide an apparatus wherein the bobbins must cover a short distance on their way from the magazine to the consuming or processing machine.

An additional object of the invention is to provide a bobbin changing apparatus each and every phase of operation of which can be fully automated so that the replacement of expired bobbins with fresh bobbins in a production line for filter cigarettes or the like need not be supervised at all.

Still another object of the invention is to provide a novel and improved method of manipulating fresh bobbins on their way to the consuming station of a filter tipping, cigarette rod making or like machine.

Another object of the invention is to provide novel and improved spindles which can support bobbins of convoluted cigarette paper or the like in machines for the production of rod-shaped smokers' products.

A further object of the invention is to provide an apparatus which can be used as a superior substitute for heretofore known bobbin changing apparatus in machines for the making of rod-shaped smokers' articles.

One feature of the invention resides in the provision of an apparatus for manipulating bobbins of convoluted flexible material, such as webs of cigarette paper, tipping paper or other types of paper which are processed in cigarette making, filter tipping, filter rod making and like machines of the tobacco processing industry. The apparatus comprises a magazine, a support which is spaced apart from the magazine, and means for transferring discrete bobbins from the magazine to the support, e.g., onto one of several retractable spindles of the support. The transferring means comprises a gripping device having means for engaging the peripheries of discrete bobbins and means for moving the device between the magazine and the support. The spindle or spindles of the support constitute and/or are equipped with means for receiving and retaining the customary cores of bobbins which are delivered by the gripping device. The gripping device can comprise substantially annular tongs and the moving means can include means for locating the tongs at the magazine in a position of at least substantial concentricity with the bobbin which is awaiting transfer to the support. The tongs can constitute an at least substantially complete annulus defining a central opening for the bobbin which is being transferred to the support.

In accordance with a presently preferred embodiment of the apparatus, the magazine comprises means (e.g., an elongated centering mandrel) for maintaining the axes of the supply of bobbins in the magazine in positions of coincidence with or at least close to a first predetermined axis, and the spindle or spindles of the support are designed to define for the transferred bobbins a second axis which is preferably normal to the first axis. The moving means preferably includes means for changing the orientation of the gripping device during transfer of bobbins to the support so that the axis of the bobbin which reaches the selected receiving means of the support coincides with or is at least close to the second axis. The orientation changing means preferably includes means for pivoting the gripping device about a third axis (e.g., about a horizontal axis) which is inclined with reference to the first and second axes. One of the axes (particularly the second axis) is preferably horizontal, another of the axes (particularly the first axis) is preferably vertical, and the third axis is preferably normal to the first and second axes.

The orientation changing (pivoting) means preferably comprises a crank drive.

If the first axis is vertical or substantially vertical, the apparatus preferably further comprises elevator means for reciprocating the tongs of the gripping device along a path which is parallel or substantially parallel to the first axis. The elevator means (e.g., including a motor-driven chain for the tongs, and one or more upright guides for the tongs) is preferably designed to move the tongs to a predetermined uppermost position in which the tongs can surround the topmost bobbin of the supply of bobbins when the supply is replenished so that the magazine contains a maximum number of stacked bobbins, and the orientation changing means is then designed to change the orientation of the tongs during transfer from such predetermined uppermost position to a second position in which the axis of the bobbin in the tongs coincides with or is at least very close to the axis of the selected spindle of the support. Thus, when the magazine contains less than a maximum number of bobbins, the elevator means lifts the tongs (with a gripped bobbin therein) to the predetermined uppermost position before the orientation of the tongs is changed for the purpose of transferring the bobbin to the support.

The tongs of the gripping device preferably comprises a carrier and the engaging means can comprise an annulus of neighboring claws or other suitable bobbin-engaging elements which are movably (preferably pivotably) mounted on the carrier. Such gripping device further comprises means for jointly displacing the elements relative to the carrier into and from engagement with the periphery of a bobbin which is surrounded by the annulus of bobbin-engaging elements. The displacing means can comprise links or other suitable means for articulately connecting the neighboring bobbin-engaging elements to each other, and motor means (e.g., a double-acting fluid-operated cylinder and piston unit) for pivoting one of the elements whereby the other elements are pivoted toward or away from the periphery of the surrounded bobbin by way of the connecting means.

The support preferably includes at least one extendable and retractible spindle which is mounted in an indexible holder and comprises a core retainer and actuating means for moving the retainer into and from engagement with the core of a bobbin which is transferred from the magazine by the gripping device. The core receiver can comprise a plurality of mobile clamping elements in the form of one-piece or composite claws and means for shifting the clamping elements into and from radial and axial engagement with the core of a transferred bobbin in response to operation of the actuating means. The shifting means preferably comprises a rotary bearing element and means for movably securing the clamping elements to the bearing element. The latter preferably comprises an axial stop for the core of a freshly transferred bobbin and the means for movably securing the clamping elements to the bearing element can comprise a first axially movable shifting member in the bearing element, a second axially movable shifting member in the first shifting member, and means for articulately connecting each clamping element to the first and second shifting members. The means for articulately connecting can comprise pivot means for attaching the clamping elements to one of the shifting members (e.g., to the first shifting member) and links for attaching the clamping elements to the other shifting member.

If each of the clamping elements comprises a pair of legs and means for pivotally coupling the legs to each other, the means for movably securing the clamping elements to the bearing element preferably comprises means for pivotally connecting one leg of each clamping element directly to the bearing element. The actuating means of such spindle preferably comprises a pusher which is axially movably mounted in the core retainer and has rollers or otherwise configurated follower means adjacent to the legs of the clamping elements and means for reciprocating the pusher to thereby pivot the legs of the clamping elements relative to the core of a bobbin in response to axial movement of the pusher. Such actuating means can be mounted directly on the core retainer. The means for reciprocating the pusher preferably comprises a spring for biasing the pusher axially in a first direction and a preferably fluid-operated motor for moving the pusher axially in a second direction counter to the first direction. The spring is preferably mounted to bias the pusher in a direction to effect a movement of at least one leg of each clamping element into engagement with the core of a bobbin. The actuating means of the just discussed spindle can further comprise resilient means for biasing the pusher in a first direction so as to disengage the clamping elements from the core of a bobbin and a motor for moving the pusher axially in a second direction so that the pusher performs an overstroke and moves the bearing element axially and away from the core of a bobbin.

The legs of each composite clamping element are preferably biased by discrete springs (e.g., by discrete torsion springs) in directions to disengage the clamping elements from the core of a bobbin.

Still further, the bearing element of each spindle can comprise an axial stop for the core of a bobbin and means for adjusting the clamping elements with reference to such stop so that the stop and the clamping elements can cooperate to engage and retain cores having different axial lengths. To this end, each bearing element can comprise a main portion which is rotatably mounted in the holder of the support and is provided with the axial stop, and a second portion which is threadedly connected to the main portion and carries the clamping elements.

Another feature of the invention resides in the provision of a combination of parts including a tobacco processing machine (e.g., a cigarette rod making machine) which consumes webs of wrapping material or the like with (a) an apparatus for manipulating bobbins of convoluted webs, such as cigarette paper, and including a magazine arranged to store a supply of bobbins, a support, and means for transferring discrete bobbins from the magazine to the support and including a gripping device having means for engaging the peripheries of discrete bobbins and means for moving the device between the magazine and the support, (b) means for indexing or otherwise moving the support between a receiving station at which the support accepts bobbins from the transferring means and a web dispensing station, (c) a mechanism for splicing the web of a bobbin which is located at the dispensing station to the web of a bobbin at the receiving station, and (d) means for withdrawing the web from the bobbin at the receiving station and for transporting the web to the splicing mechanism.

Such combination can further comprise means defining a path for the advancement of webs from the splicing mechanism to the processing machine, e.g., to the tobacco filler wrapping mechanism of a cigarette rod making machine.

The support preferably includes a holder (e.g., a two-armed lever) with two retractible and extendable spindles for the cores of bobbins. One of the spindles is located at the receiving station when the other spindle is located at the web dispensing station, and vice versa.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIGS. 6*a* to 6*c* show three stages of detachment of an expired bobbin from a spindle of the support which is shown in FIGS. 4 and 4*a.

DESCRIPTION OF THE PREFERRED EMBODIMENTS

Figure 1:
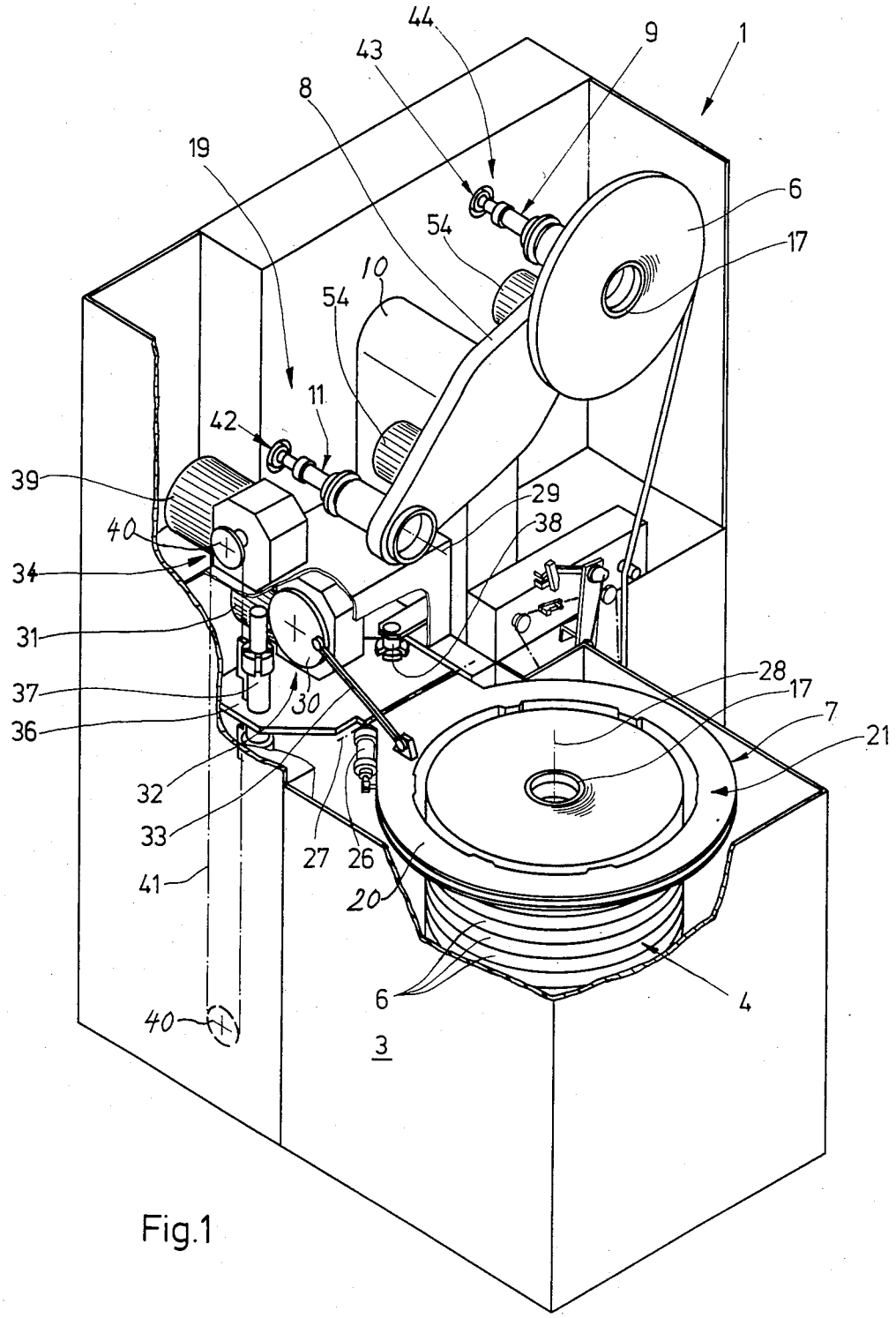
FIG. 1 is a perspective view of an apparatus which embodies one form of the invention.
Figure 2:
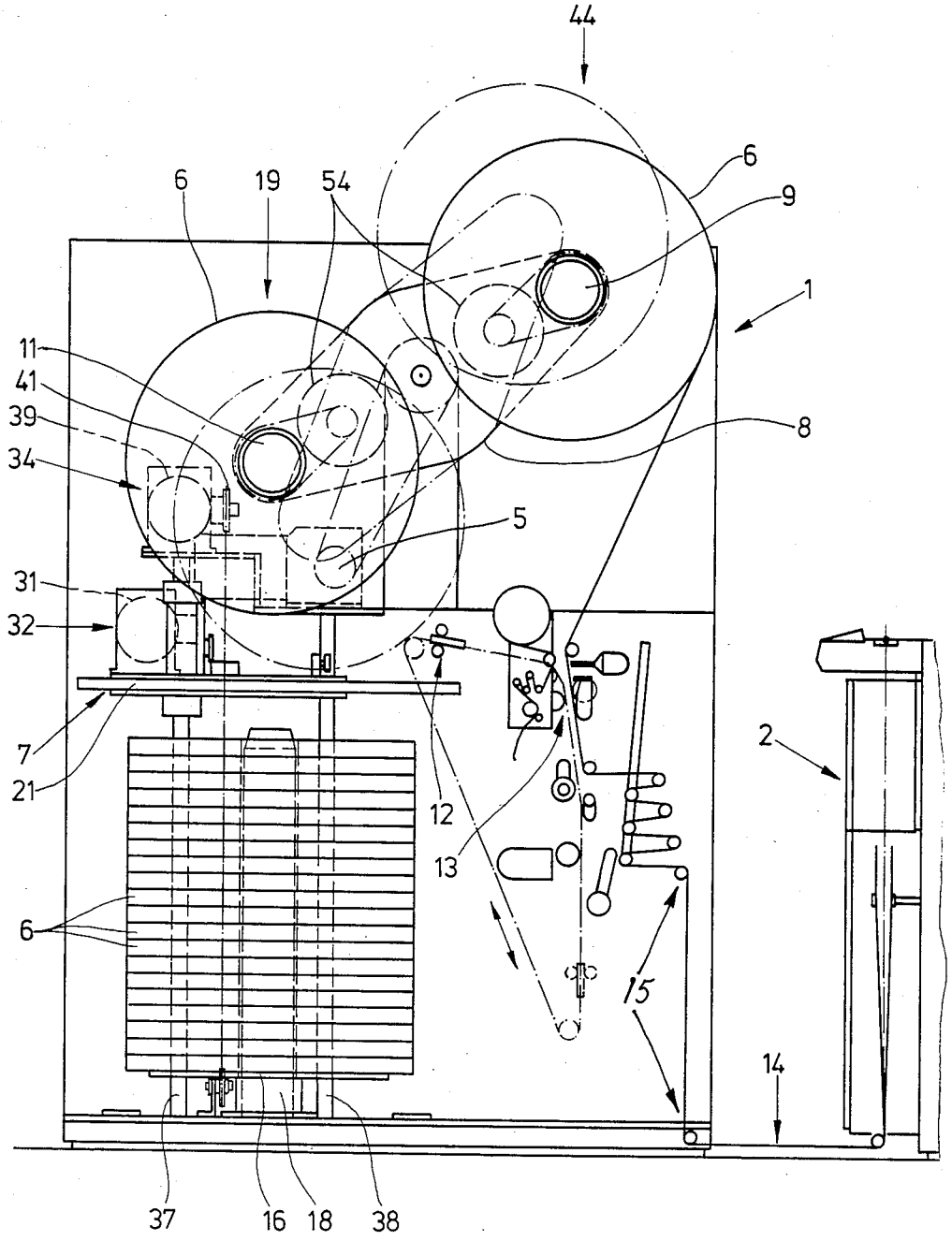
FIG. 2 is a smaller-scale front elevational view of the apparatus, further showing a portion of a cigarette making machine, a web splicing mechanism and a mechanism which can deliver the leaders of fresh webs to the splicing mechanism.

Referring first to FIGS. 1 and 2, there is shown an apparatus 1 which is designed to manipulate discrete bobbins 6 each of which includes a tubular core or hub 17 and a supply of convoluted wrapping material in the form of a cigarette paper web, a web of tipping paper, a web of material which is used to wrap the filler of filamentary or other filter material in a filter rod making machine or any other web which can be utilized in a tobacco processing plant. In the embodiment of FIGS. 1 and 2, the apparatus 1 is installed in or cooperates with a cigarette making machine 2, e.g., a machine known as Protos which is manufactured by the assignee of the present application and can turn out up to and in excess of 8000 plain cigarettes per minute. In such machines, bobbins of cigarette paper must be replaced at very frequent intervals so that the utilization of a fully automated bobbin changing apparatus contributes significantly to a reduction of the cost of operation as well as to further automation of cigarette making. The illustrated apparatus 1 is designed as a self-sustaining unit which can be mounted on wheels or can be permanently installed next to the cigarette making machine 2.

One of the main components or units of the apparatus 1 is a magazine 3 which stores a supply 4 of superimposed fresh bobbins 6. Another unit 7 of the apparatus 1 is a (gripping) means for transferring successive topmost bobbins 6 of the supply 4 in the magazine 3 onto one of two bobbin receiving and retaining means 9, 11 which constitute two parts of a support further including a pivotable (indexible) holder 8 in the form of a two-armed lever and means (e.g., a motor 5 in the housing 10) for pivoting the holder 8 about a horizontal axis. The spindles 9, 11 are mounted at the respective ends of the holder 8 and are alternately movable to a receiving station 19 at which the spindle 9 or 11 is ready to accept a fresh bobbin 6 from the transferring means 7. The axes of the spindles 9, 11 are parallel to each other, and the axis of the spindle (note the spindle 11 in each of FIGS. 1 and 2) which occupies the receiving station 19 coincides with a predetermined (second) axis 29. The common vertical axis of the supply 4 of bobbins 6 in the magazine 3 is shown at 28. Such axis is defined by an upright centering mandrel 18 which extends into the cores 17 of stacked bobbins 6 in the magazine 3.

The transferring means 7 is movable to a level above the magazine 3 preparatory to transfer of a freshly engaged bobbin 6 to the receiving station 19. One of the spindles 9, 11 is located at a second or web dispensing station 44 to rotate a bobbin 6 thereon in a direction to pay out the respective web (note the web 14). Such web passes through a splicing mechanism 13, whose construction and mode of operation form no part of the present invention, on its way to the wrapping mechanism of the cigarette making machine 2. The wrapping mechanism drapes the web 14 around a continuous rod-like tobacco filler so that the web is converted into the tubular envelope of the resulting cigarette rod before the latter is subdivided into plain cigarettes of unit length or multiple unit length. The reference character 12 denotes a mechanism which can withdraw the leader of the bobbin 6 at the receiving station 19 and advances the leader to the splicing mechanism 13 where the leader is attached to the trailing end of the web 14 upon complete or nearly complete expiration of the bobbin 6 at the dispensing station 44. The withdrawing mechanism 12 is or can be identical with that which is disclosed in the commonly owned copending patent application Ser. No. 794,109 filed Nov. 1, 1985 (now U.S. Pat. No. 4,646,986) by Bob Heitmann for "Apparatus for locating, engaging and transporting the leader of convoluted cigarette paper or the like". The path 15 for the web 14 between the splicing mechanism 13 and the wrapping mechanism of the cigarette making machine 2 is defined by a set of rollers which can establish and maintain a relatively small supply of cigarette paper immediately downstream of the splicing station.

The illustrated magazine 3 can be replaced with a modified magazine utilizing or constituting a mobile pallet for a supply of bobbins 6 thereon. It is presently preferred to employ a stationary magazine in view of the substantial weight of a full stack 4 of bobbins as well as because it is easier and simpler to ensure accurate positioning of bobbins in a stationary magazine. The magazine 3 includes a stationary horizontal table 16 for the lowermost bobbin 6 of the stack, and the aforementioned centering mandrel 18 which extends upwardly beyond the table 16 and into the cores 17 of the stacked bobbins.

Figure 3:
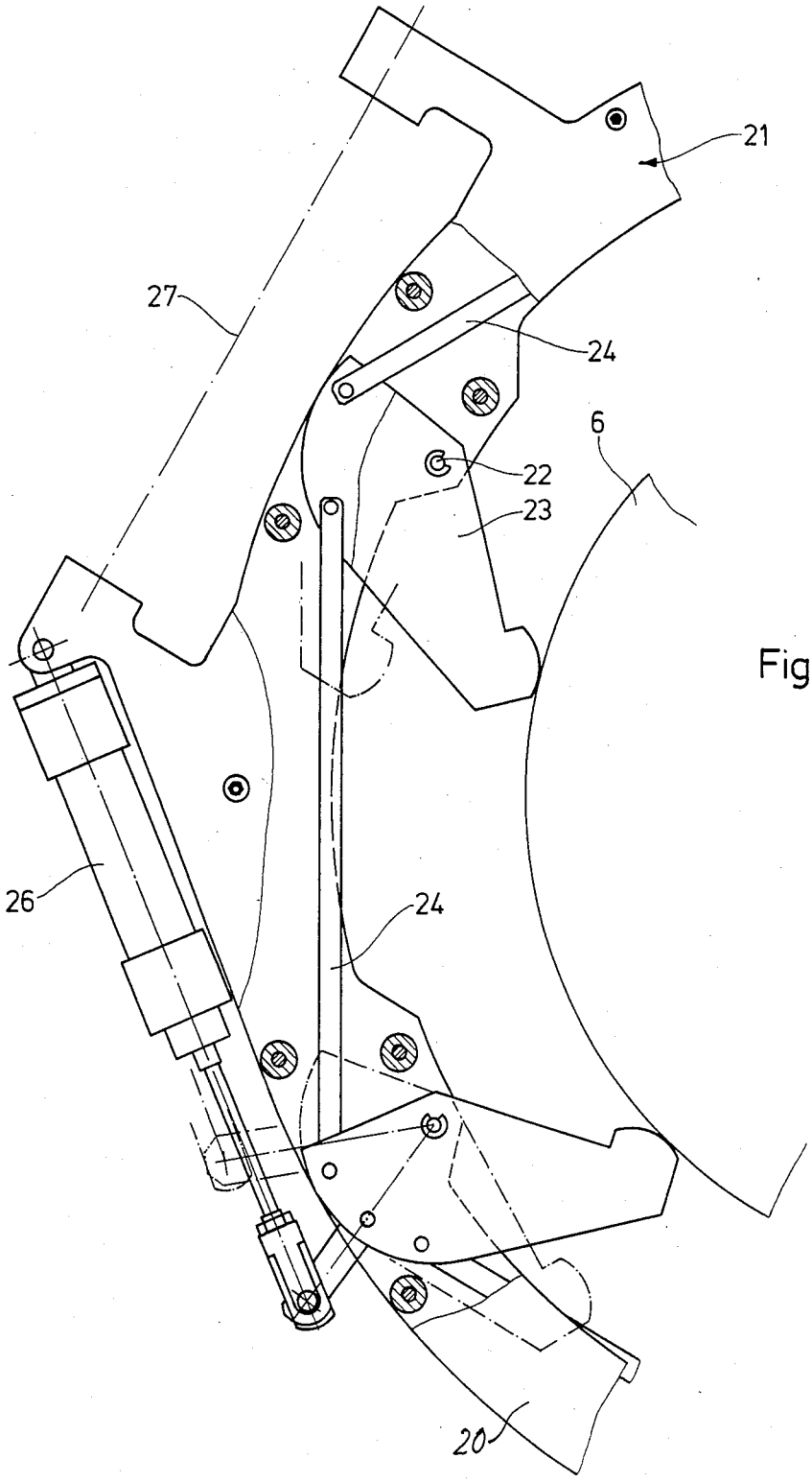
FIG. 3 is an enlarged fragmentary plan view of the bobbin transferring means in the apparatus of FIG. 1.

The transferring means 7 comprises a gripping device in the form of preferably annular tongs 21 having a ring-shaped frame or carrier 20 for an annulus of equidistant neighboring claw-shaped bobbin-engaging elements 23 (see FIG. 3) which are articulately connected to the carrier 20 by pivot pins 22. The means for displacing the elements 23 relative to the carrier 20, namely for moving the pallets of such elements substantially radially of the carrier 20 toward and away from the periphery (i.e., the outer side of the outermost convolution of the web) of the topmost fresh bobbin 6 in the magazine 3 comprises connecting means in the form of links 24 which articulately connect the neighboring elements 23 to each other and a fluid-operated (preferably pneumatic) motor 26 which can pivot one of the elements 23 to thereby pivot the remaining elements 23 through the medium of the links 24. The carrier 20 is pivotable about the horizontal axis 27 of a shaft which is mounted on the platform 36 of an elevator 34 for the tongs 21. The arrangement is such that the tongs 21 can be pivoted through 90 degrees between a first position in which the bobbin engaging elements 23 are disposed in a horizontal plane and surround the topmost bobbin 6 of the supply 4 in the magazine 3, and a second position (at the receiving station 19) in which the elements 23 are disposed in a vertical plane and maintain the freshly transferred bobbin 6 in front of the spindle 9 or 11 at the station 19.

It will be noted that the axis 27 for the shaft of the carrier 20 is normal to the vertical axis 28 of the centering mandrel 18 and of the stack of bobbins 6 in the magazine 3 as well as to the horizontal axis 29 of the spindle 9 or 11 at the receiving station 19. The means for changing the orientation of the carrier 20, i.e., for pivoting the tongs 21 between the aforediscussed positions, comprises a crank drive 32 including a motor 31 which drives an eccentric 30 so that the latter can impart appropriate movements to a connecting rod 33 which is coupled to the carrier 20.

The elevator 34 is designed to move the tongs 21 up and down along a vertical path in parallelism with the axis 28 of the stacked bobbins 6 in the magazine 3. The platform 36 of the elevator 34 carries the shaft (defining the axis 27) for the carrier 20 and the crank drive 32. The elevator 34 further comprises an endless chain 41 which is trained over sprocket wheels 40 and is connected to the platform 36. The upper sprocket wheel 40 can be driven by a motor 39 which is installed in the frame of the bobbin changing or manipulating apparatus 1. The platform 36 is reciprocable along two upright guide rods 37, 38 (shown only in FIG. 2) which are parallel to the mandrel 18. The purpose of the elevator 34 is to enable the tongs 21 to descend to the level of the topmost bobbin 6 in the magazine 3 when the supply 4 of such bobbins is partly depleted so that the elements 23 can properly engage the peripheral surface of such topmost bobbin, and to thereupon lift the tongs 21 and the bobbin 6 in the centrally located opening of the carrier 20 to an upper end position in which the motor 31 is actuated to pivot the tongs 21 from a horizontal plane to a vertical plane and to thus change the orientation of the gripped bobbin by 90 degrees whereby the bobbin is located at the receiving station 19 and can be accepted by the spindle 9 or 11.

FIG. 1 shows a maximum supply 4 of fresh bobbins 6 in the magazine 3, i.e., the topmost bobbin of such supply is disposed in the opening of the carrier 20 while the elevator 34 maintains the platform 36 (and hence the tongs 21) in the upper end position. FIG. 2 shows the tongs 21 in the same upper end position but the supply 4 of bobbins 6 in the magazine 3 is partially depleted. The tongs 21 are assumed to hold a fresh bobbin 6 which is thus ready to be transferred to the receiving station 19.

An important advantage of the illustrated tongs 21 is that the bobbins 6 are treated gently. This is due to the fact that the elements 23 are uniformly distributed around the periphery of the bobbin 6 within the confines of the carrier 20 and that the tongs 21 comprise a substantial number of elements 23 so that the forces which must be applied by the elements 23 to safely engage and hold the bobbin during transfer from the magazine 3 to the support including the holder 8 and the spindles 9, 11 can be distributed all the way around the bobbin. Such uniform distribution of forces greatly reduces the likelihood of excessive deformation of the bobbin during transfer to the receiving station 19. In fact, the pallets of the elements 23 can actually reshape a deformed bobbin as a result of engagement with the exposed surface of the convoluted web of cigarette paper. A further important advantage of the improved bobbin transferring means is that the pallets of the elements 23 engage the exposed surface of the outermost convolution which is normally discarded subsequent to splicing. To this end, the splicing mechanism 13 preferably comprises a knife which severs the leader of the fresh web ahead of the freshly formed splice and means for attracting the severed portion of the leader. Reference may be had to the aforementioned copending patent application of Heitmann. The severed portion of the leader constitutes at least the major part of the outermost convolution so that depressions or any other marks which are left by the pallets of the elements 23 do not enter the cigarette making machine 2.

The extent to which the elements 23 are pivotable with reference to their carrier 20 is preferably selected in such a way that the tongs 21 can transfer bobbins whose diameters deviate from a standard diameter or that the tongs can transfer bobbins having predetermined first diameters as well as bobbins having predetermined second, third, etc. diameters. Such pivotability of the elements 23 enhances the versatility of the transferring means 7 including the tongs 21.

When the topmost bobbin 6 of the supply 4 in the magazine 3 is properly engaged by the elements 23 of the tongs 21, the tongs are pivoted by the crank drive 32 so that the orientation of the engaged bobbin 6 is changed through 90 degrees. Such change in orientation is preceded by actuation of the motor 39 to raise the tongs 21 to the upper end position if the magazine 3 contains less than a maximum supply of stacked bobbins 6. The motor 39 can lower the platform 36 incrementally whereby the number of steps depends on the level of the topmost bobbin 6 in the magazine 3. The exact manner in which the level of the topmost bobbin 6 of the supply 4 can be detected and in which the thus generated signals are transmitted to the motor 39 to lower the tongs 21 forms no part of the present invention.

The axis of the core 17 of the bobbin 6 at the receiving station 19 coincides with the axis 29 of the spindle 9 or 11 which is ready to accept such bobbin from the tongs 21.

The manner in which a fresh bobbin 6 is taken over and retained by the spindle 9 or 11 at the receiving station 19 and in which the core 17 of an expired bobbin is released and ejected at the web dispensing station 44 is illustrated in FIGS. 4, 4*a*, 5*a* to 5*d* and 6*a* to 6*c*. The upper portions of FIGS. 4 and 4*a* (above the axis X—X) show a bobbin 6 in a position which it assumes while its core 17 is secured to the spindle 9 or 11, and the lower portions of these Figures show the core 17 of an expired bobbin after it has been released by the spindle 9 or 11 so that it can be removed or that it can descend by gravity preparatory to renewed pivoting or indexing of the holder 8 so as to transfer the corresponding spindle from the station 44 to the station 19.

Figures 4, 4A:
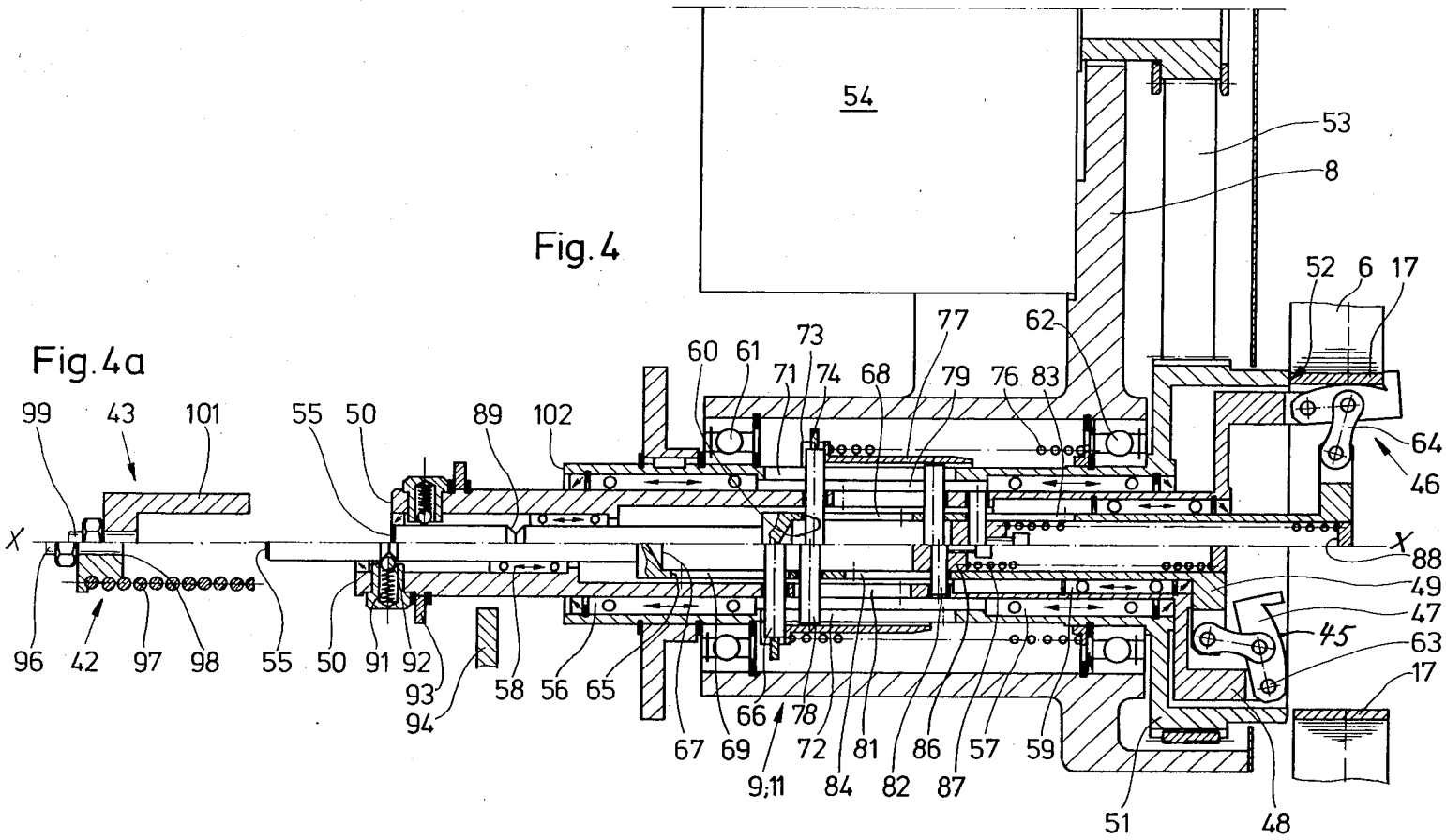
FIGS. 4 and 4*a* are enlarged fragmentary sectional views of a support for fresh and expiring bobbins.
Figure 5A:
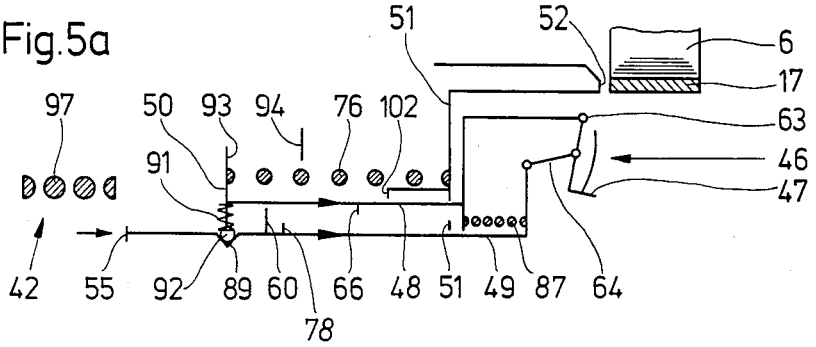
FIGS. 5*a* to 5*d* show schematically four stages of attachment of a fresh bobbin to a spindle of the support which is shown in FIGS. 4 and 4*a;*
Figure 5B:
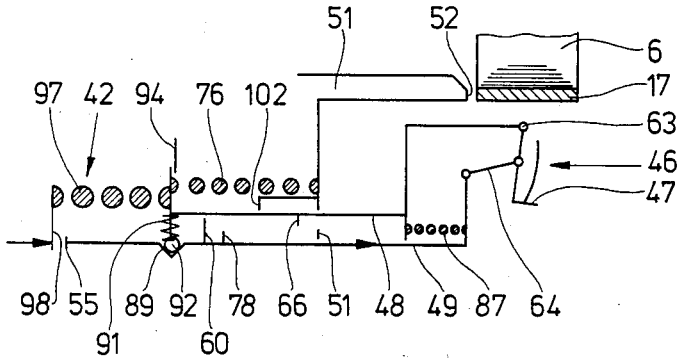
Figure 5C:
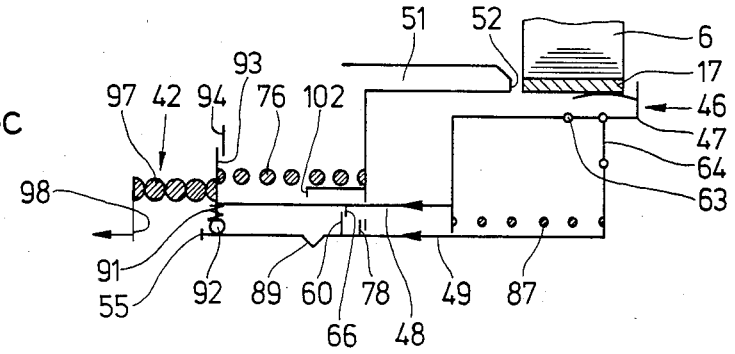
Figure 5D:
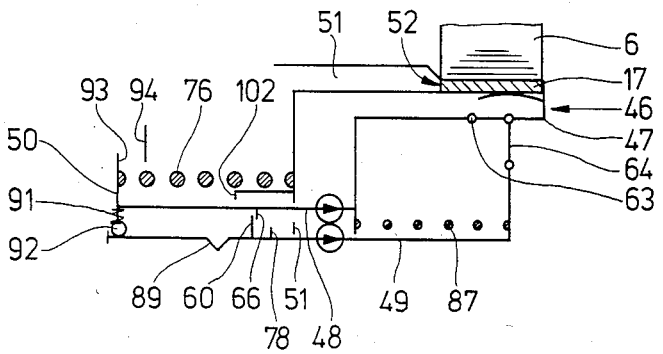
Figure 6A:
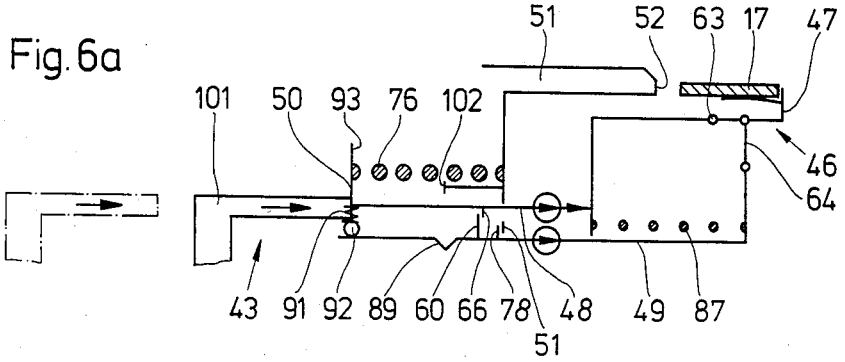
Figure 6B:
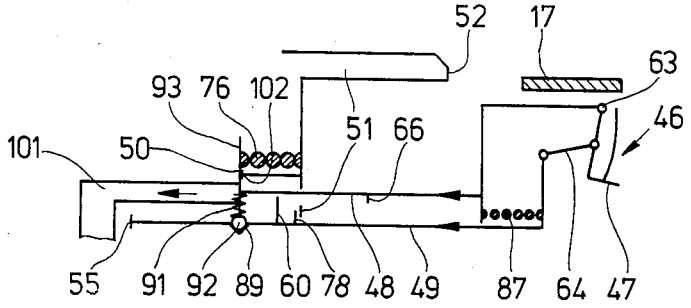
Figure 6C:
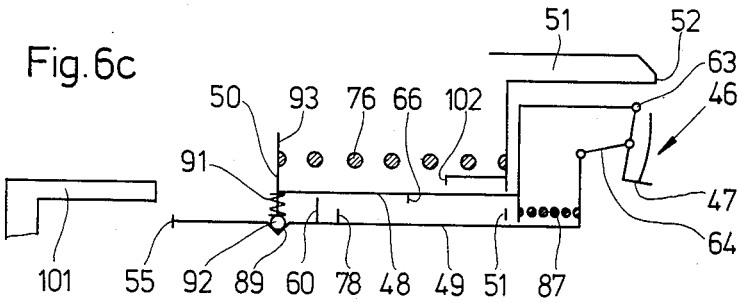

The means for releasably securing a fresh bobbin 6 to the spindle 9 or 11 at the receiving station comprises a first actuating device 42, and the means for disengaging the core 17 of an expired bobbin from the spindle 9 or 11 at the station 44 comprises a discrete second actuating device 43. Each of the actuating devices 42, 43 can be operated independently of the other. Only one-half of each of the two actuating devices is shown in FIGS. 4 and 4*a*.

Each of the spindles 9, 11 comprises an axially movable as well as radially expandible and contractible core receiver 46 which is provided with mobile core clamping elements in the form of jaws 47, e.g., with a set of six equidistant jaws. Such jaws are pivotably mounted on a first axially movable shifting member 48 by means of pivot pins 63 and on a second axially movable shifting member 49 by means of links 64. The shifting member 48 is reciprocable by the actuating device 42, and the shifting member 49 is reciprocable by the actuating device 43. The members 48 and 49 are installed in a common cylindrical bearing element 51 which defines an axial stop 52 for the cores 17 of bobbins 6 and can be driven by a motor 54 through the medium of a toothed belt 53. The bearing element 51 is rotatable in the holder 8 which also supports the motor 54. Annuli of antifriction rolling elements 56 and 57 are installed between the bearing element 51 and the elongated sleeve-like shifting member 48. Similar annuli of antifriction rolling elements 58 and 59 are installed between the shifting member 48 and the substantially rod-like (but hollow) shifting member 49. The bearing element 51 is rotatable in two antifriction ball bearings 61, 62 which are installed in the holder 8. The annuli of rolling elements 56 to 59 and the bearings 61, 62 ensure that the members 48, 49 are properly centered relative to each other and relative to the bearing element 51 as well as that the element 51 is properly centered in the holder 8. The shifting member 49 is telescoped into the shifting member 48, and the latter is telescoped into the holder 8.

The shifting members 48, 49 are movable axially as a unit as well as relative to each other. To this end, the shifting member 48 (hereinafter called sleeve for short) is provided with a transversely extending diametral entraining pin 66 whose central portion extends across an axial bore 67 as well as transversely through two axially parallel elongated slots 68, 69 of the shifting member 49 (hereinafter called rod for short). The end portions of the pin 66 extend radially beyond the sleeve 48 and into the respective longitudinally extending axially parallel slots 71, 72 of the bearing element 51. The pin 66 is held against axial movement by a ring-shaped cap 73 and a retaining ring 74. The sleeve 48 is biased axially by a coil spring 76 which bears against the pin 66 and reacts against the ball bearing 62 for the bearing element 51. The spring 76 surrounds a cylindrical muff 77 which, in turn, surrounds a portion of the bearing element 51.

The rod 49 carries a transversely extending stud 78 which extends through axially parallel elongated slots 79 and 81 of the sleeve 48 and whose end portions extend into the aforementioned axially parallel elongated slots 71 and 72 of the bearing element 51. A second stud 82 is mounted in the sleeve 48 and extends transversely of the common axis of the sleeve 48 and rod 49 so as to pass through two axially parallel elongated slots 83, 84 of the rod 49 and to hold a slidable block 86 which is installed in the axial bore 67 of the rod 49. The block 86 constitutes a retainer for one end of a coil spring 87 and bears against an internal shoulder 88 of the rod 49.

The external surface of the rod 49 is formed with a female detent portion including a circumferentially extending groove 89, and the sleeve 48 carries a complementary male detent portion including a set of equidistant spherical detent members 92 which are biased radially inwardly by discrete coil springs 91. The detent members 92 cannot be completely expelled from their radial bores in the sleeve 48 but their innermost portion can snap into the groove 89 under the action of the respective springs 91 in predetermined axial positions of the sleeve 48 and rod 49 relative to each other.

The sleeve 48 carries a ring-shaped abutment 93 which can cooperate with a stationary arresting member 94 at the receiving station 19, i.e., when the spindle 9 or 11 carrying the respective sleeve 48 is ready to accept a fresh bobbin 6 from the tongs 21.

The actuating device 42 can be set in operation by the piston rod 96 of a fluid-operated (preferably pneumatic) motor which is installed at the receiving station 19. This actuating device comprises a tension spring 97 which acts upon the end face 50 of the sleeve 48 at the receiving station 19, and a front face 98 which can engage the adjacent end face 55 of the rod 49 at the station 19.

The actuating device 43 can be set in operation by the piston rod 99 of a second fluid-operated (preferably pneumatic) motor at the web dispensing station 44. This actuating device comprises a rigid tubular motion transmitting portion 101 which can engage end face 50 of the sleeve 48 at the station 44.

As mentioned above, each of the spindles 9, 11 comprises a motor driven bearing element 51, a sleeve 48 which is axially movably telescoped into the bearing element 51, and a rod 49 which is axially movably telescoped into the sleeve 48.

The manner in which one of the spindles 9, 11 (e.g., the spindle 11) can receive a fresh bobbin 6 from the tongs 21 will be described with reference to FIGS. *5a* to *5d*. At first, the claws 47 of the core receiver 46 forming part of the spindle 11 are held in the retracted positions (see the lower part of FIG. 4). It will be seen that the claws 47 are retracted radially and axially so that their pallets are disposed radially inwardly of the respective pivot pins 63 and the links 64 extend in substantial parallelism with the axis X—X. In a first step, the tension spring 97 of the actuating device 42 is caused to bear against the end face 50 of the sleeve 48 which forms part of the spindle 11 (such biasing is caused by the piston rod 96 of the fluid-operated motor which operates the actuating device 42). This is shown in FIG. *5a*. At such time, the spherical detent members 92 of the sleeve 48 extend into the groove 89 of the rod 49 so that the parts 48, 49 are coupled to each other for axial movement in a direction to the right, as viewed in FIG. *5a*. When the parts 48 and 49 reach the positions which are shown in FIG. *5b*, the ring-shaped abutment 93 of the sleeve 48 reaches and is arrested by the stationary arresting member 94 at the receiving station 19. At such time, the coil spring 76 which surrounds the muff 77 stores energy due to the preceding axial movement of the parts 48, 49 relative to the bearing element 51.

The actuating device 42 continues to move in a direction to the right, as viewed in FIG. *5b*, whereby its front end face 98 reaches the end face 55 of the rod 49 and the latter begins to move relative to the to the sleeve 48 which is held against such movement by the stationary arresting member 94. Consequently, the detent members 91 are expelled from the groove 89 which, in turn, enables the prestressed coil spring 87 (which acts between the retainer 86 on the stud 82 and the internal shoulder 88) to abruptly propel the rod 49 in the same direction, i.e., to the right, as viewed in FIG. *5b*, so that the rod 49 reaches the position of FIG. *5c*. Such abrupt rightward movement of the rod 49 relative to the sleeve 48 is terminated by the pin 66 of the sleeve 48 because such pin is contacted by the surfaces 60, 65 in the slots 68, 69 of the rod 49. Axial shifting of the rod 49 relative to the arrested sleeve 48 entails an axial and radial movement of the jaws 47 whose convex surfaces 45 engage the internal surface of the core 17 forming part of a fresh bobbin 6 which is held at the receiving station 19 by the tongs 21. Thus, the core 17 is then engaged by the jaws 47 of the core retainer 46 of the spindle 11 while the elements 23 of the tongs 21 still engage the peripheral surface of the bobbin 6 at the receiving station 19. The motor 26 is thereupon actuated in a direction to disengage the elements 23 from the bobbin 6 so that the latter is then held solely by the jaws 47.

In the next step, the piston rod 96 causes or allows the actuating device 42 to move in a direction to the left, as viewed in FIG. *5c*, to the position of FIG. *4a*. The stressed spring 76 is then free to dissipate energy and to move the sleeve 48 in a direction to the left, namely to the position of FIG. *5d*. The pin 66 of the sleeve 48 bears against the surfaces 60, 65 in the respective slots 68, 69 of the rod 49 so that the latter shares the leftward movement of the sleeve 48. Consequently, the entire core retainer 46 of the spindle 11 is moved to the left and the pallets of its jaws 47 move the core 17 of the freshly transferred bobbin 6 against the axial stop 52 of the bearing element 51. The corresponding positions of the parts of the spindle 11 are shown in the upper part of FIG. 4. This completes the transfer of the bobbin 6 onto the spindle 11 so that the motor 5 can pivot the holder 8 in order to transfer the spindle 11 (and the bobbin 6 thereon) from the receiving station 19 to the web dispensing station 44 where the corresponding motor 54 is started to drive the bearing element 51 in a direction to cause the bobbin 6 to pay out its web 14. Pivoting of the holder 8 for the purpose of transferring the spindle 11 and the fresh bobbin 6 thereon from the station 19 to the station 44 is preceded by a splicing operation, i.e., the web 14 of the expiring bobbin at the station 44 is spliced to the leader of the web of the bobbin 6 which is held by the spindle 11 at the station 19. As mentioned above, the splicing operation is preceded by actuating of the withdrawal mechanism 12 which transfers the leader of the web forming part of the bobbin 6 on the spindle 11 at the station 19 to the splicing station so that the splicing mechanism 13 can be set in motion as soon as the diameter of convoluted web on the bobbin at the station 44 has been reduced to a predetermined minimum value. The splicing mechanism 13 first accelerates the leader of the fresh web to the speed of the running web 14, the thus accelerated web of the fresh bobbin is then secured to the running web, the web of the expired bobbin is severed immediately behind the splice, and the leader of the web coming from the fresh bobbin 6 on the spindle 11 is severed immediately in front of the splice.

Once the splicing operation is completed, the core 17 of the expired bobbin at the station 44 is ready for ejection. The manner in which the core of such expired bobbin is released by the jaws 47 of the core receiver 46 forming part of the spindle (9) at the station 44 is illustrated in FIGS. *6a, 6b* and *6c*. In the first step, the piston rod 99 of the actuating device 43 at the station 44 moves the tubular motion transmitting portion 101 of the actuating device 43 against the end face 50 of the sleeve 48 (see FIG. *6a*) whereby the sleeve 48 moves in a direction to the right and entrains the rod 49. Such axial movement of the sleeve 48 entails a movement of the core 17 of the expired bobbin at the station 44 away from the axial stop 52 of the bearing element 51. The rod 49 ceases to share the just described axial movement of the sleeve 48 when its stud 78 reaches the ends of the slots 71 and 72 in the bearing element 51 (which cannot move axially of the holder 8). At such time, the tubular motion transmitting portion 101 of the actuating device 43 begins to shift the sleeve 48 relative to the rod 49 whereby the springs 76 and 87 are caused to store energy and the jaws 47 are pivoted radially inwardly to thus release the core 17 of the expired bobbin at the web dispensing station 44.

Axial shifting of the sleeve 48 relative to the rod 49 is terminated when its ring-shaped abutment 93 reaches the end face 102 of the bearing element 51. At such time (see FIG. 6*b*), the sleeve 48 is force-and form-lockingly reconnected with the rod 49 because its detent members 92 snap into the groove 89.

In the next step, the piston rod 99 is retracted or is allowed to yield in a direction to the left, as viewed in FIG. 4*a*, so that the tubular portion 101 of the actuating device 43 can move to the left and permits the spring 76 to dissipate energy. This entails a common axial movement of the sleeve 48 and rod 49 so that these parts are retracted into the bearing element 51. The parts 48, 49 also retract the respective core receiver 46 into the bearing element 51 whereby the jaws 17 are completely separated from the core 17 of the expired bobbin which is free to descend by gravity, e.g., into a collecting receptacle or onto a conveyor.

It will be noted that the entire spindle 9 is retracted into the holder 8 (i.e., the parts 48, 49 and the receiver 46 are retracted into the respective bearing element 51 which, in turn, is mounted in the holder 8) before the holder 8 is pivoted to move the spindle 9 back to the receiving station 19. This ensures that the retracted spindle 9 cannot interfere with the transfer of the spindle 11 (and of the bobbin 6 thereon) from the station 19 to the station 44. The holder 8 is pivoted in a clockwise direction, as viewed in FIG. 1 or 2, wherebythe spindle 11 (with the fresh bobbin 6 thereon) moves from the station 19 to the station 44 simultaneously with a movement of the retracted spindle 9 from the station 44 to the station 19 where the spindle 9 is ready to receive and retain a fresh bobbin 6 which is transferred by the tongs 21.

The illustrated tongs 21 can be replaced with other types of tongs without departing from the spirit of the invention. For example, the tongs could employ two substantially semicircular jaws which are pivotably secured to each other or to a carrier and can be spread apart or moved nearer to each other to thereby release or engage the periphery of a fresh bobbin. The tongs 21 with an annulus of pivotable claws or like bobbin-engaging elements 23 is preferred at this time because such elements can be caused to uniformly distribute the clamping forces all around the circumference of the fresh bobbin which is held in the opening of the carrier 20.

It is further possible to replace the tongs 21 with a clamping device employing a flexible band which can be drawn tight around the periphery of the topmost fresh bobbin 6 in the magazine 3 preparatory to transfer of the bobbin to the receiving station 19. Such types of tongs also ensure gentle treatment of fresh bobbins and are highly unlikely to deform the bobbins during removal from the magazine and/or during transfer to the support, i.e., to the spindle 9 or 11.

The provision of a transferring means (7) which changes the orientation of fresh bobbins 6 through 90 degrees during transfer from the magazine 3 to the receiving station 19 is preferred at this time because the cores 17 of the bobbins 6 which are about to be engaged by the elements 23, which are being held by the elements 23 and which are about to be taken over by the receiver 46 of the spindle 9 or 11 are accessible at all times. Moreover, such mode of transferring successive fresh bobbins 6 to the station 19 renders it possible to install the support including the holder 8 and the spindles 9, 11 in immediate or close proximity of the magazine 3 so that the apparatus 1 occupies a minimal amount of space in a production line for filter cigarettes or the like.

Pivoting of the carrier 20 for the bobbin-engaging elements 23 of the tongs 21 through 90 degrees is desirable and advantageous because such change of orientation can be effected with relatively simple and compact orientation changing means. The crank drive 31 has been found to constitute an especially simple, compact and reliable means for changing the orientation of the tongs 21 during transfer of a fresh bobbin from the magazine 3 to the receiving station 19 and during return movement of the tongs 21 to their position adjacent to or in the magazine.

As mentioned above, the elevator 34 enables the tongs 21 to engage the uppermost bobbin 6 of the supply 4 irrespective of the height of the stack of bobbins in the magazine. Moreover, the stack of bobbins in the magazine need not be lifted in response to removal of successive bobbins by the tongs 21 so that the bobbins which are stored in the magazine can be held in optimum positions for engagement by the elements 23.

Figure 7:
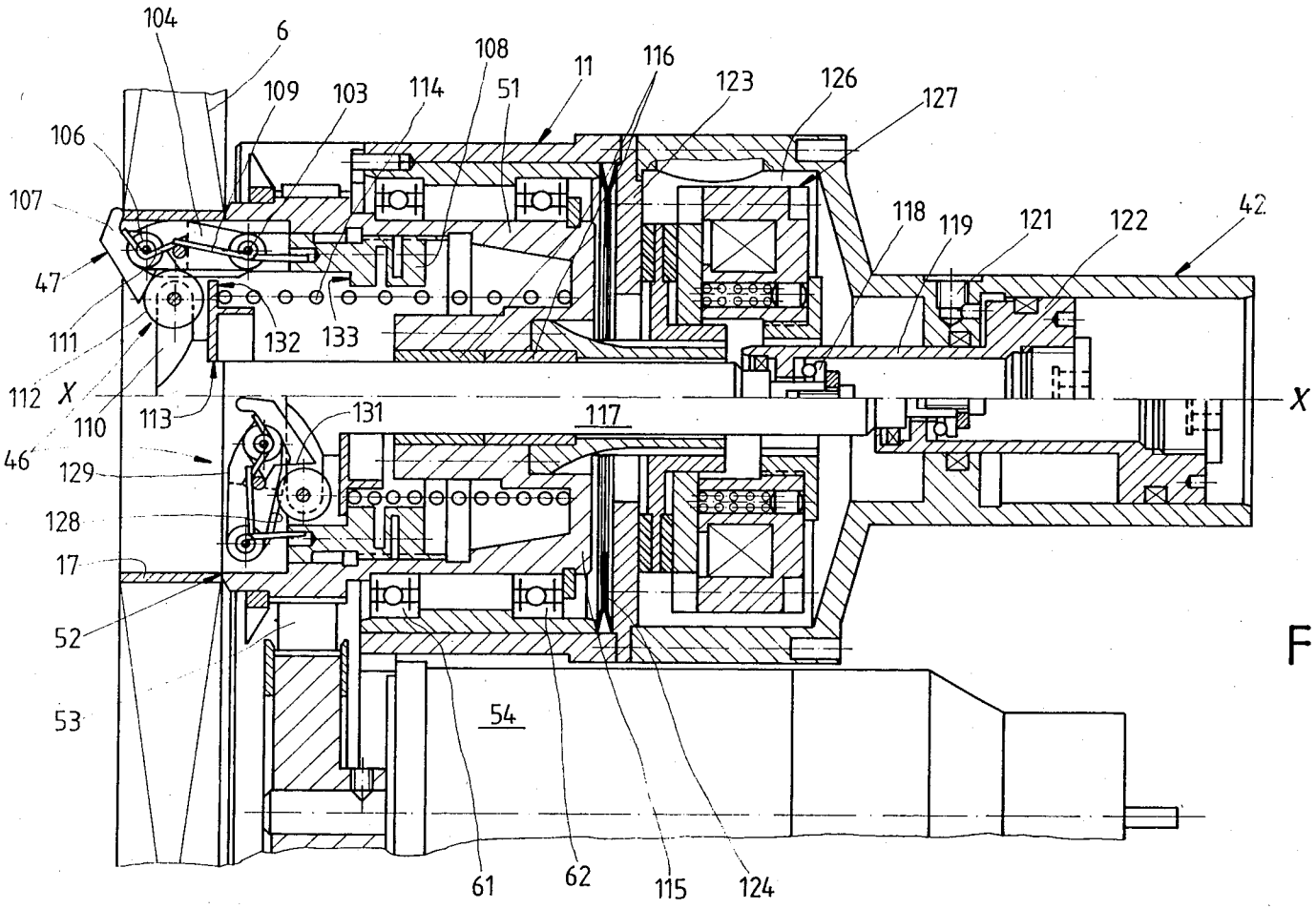
* and FIG. 7 is a fragmentary sectional view of a modified support for fresh and expiring bobbins.

FIG. 7 shows a modified construction of one (11) of the two spindles on the holder. The upper part of FIG. 7 (above the axis X—X) shows the spindle 11 in a position in which it receives and retains a fresh or an expiring bobbin 6, and the lower part of FIG. 7 (below the axis X—X) shows the spindle 11 in a position in which its receiver 46 is detached from the core 17 of an expired bobbin. The actuating device 42 for the receiver 46 of the spindle 11 is mounted directly on the spindle 11.

The receiver 46 again comprises a set of preferably equidistant core clamping elements in the form of jaws 47 which can engage and hold a core 17 against axial and/or radial movement with reference to the spindle 11. The jaws 47 are pivotably mounted directly on the bearing element 51 of the spindle 11. The bearing element 51 can be rotated by the respective motor 54 through the medium of a toothed belt 53. The annular axial stop 52 of the bearing element 51 determines the axial position of a properly retained bobbin 6.

Each of the jaws 47 is articulately connected to the bearing element 51 by a pivot pin 103 and includes a leg 104 serving to act radially against the core 17 of the adjacent bobbin 6 as well as a leg 107 which is articulately connected to the leg 104 by a pivot pin 106 and serves to hold the core 17 against axial movement.

The bearing element 51 has an internal thread which mates with the external thread of an adjusting member 108 which is movable axially of the bearing element 51 in response to its rotation about the common axis of the parts 51, 108 and whose function is to adjust the tongs including the jaws 47 so as to properly engage cores 17 having different axial lengths, i.e., to properly engage bobbins 6 having relatively wide or relatively narrow webs of cigarette paper or the like. This enables the improved apparatus to properly manipulate bobbins which store webs for smaller-diameter, medium-diameter or larger-diameter cigarette rods. The adjusting member 108 supports the pivot pins 103 for the legs 104 of the jaws 47. The adjusting member 108 can be said to constitute an axially adjustable portion of the bearing element 51. The main portion of the latter is rotatably mounted in the holder by means of antifriction ball bearings 61 and 62.

The legs 104 and 107 of each jaw 47 are respectively biased by discrete prestressed torsion springs 109 and 111. The legs 104, 107 can be pivoted by rotary members or roller followers 112 mounted on brackets 110 provided on an axially shiftable pusher 113. The latter is biased by a coil spring 114 which reacts against an internal shoulder of the bearing element 51. The pusher 113 comprises a rod-shaped portion 117 which is guided in the sleeves 116 of the bearing element 51 and can receive motion from a pneumatically actuated piston 122 in response to admission of evacuation of compressed air by way of a compressed air connection or port 121. An axial thrust bearing 118 is interposed between the portion 117 of the pusher 113 and the piston rod 119 which forms part of a pneumatically operated motor. Such motor is a component part of the actuating device 42.

The holder for the spindle 11 comprises a transversely extending partition 123 which is spaced apart from and defines with an end wall 115 of the bearing element 51 a space for a dished spring 124. A chamber 126 at one side of the partition 123 contains an electromagnetic disc brake 127 of conventional design whose function is to brake the core receiver 46 of the spindle 11.

The mode of operation of the structure which is shown in FIG. 7 is as follows:

It is assumed that the parts are held in the positions shown at a level below the axis X—X in FIG. 7, i.e., that the spindle 11 is ready to receive and retain a fresh bobbin. The jaws 47 are held in retracted positions and the port 121 is connected with the atmosphere. Therefore, the piston rod 122 of the pneumatic motor which forms part of the actuating device 42 is free to follow the bias of the coil spring 114, i.e., the roller followers 112 of the pusher 113 are caused to move outwardly and to roll in guide grooves 128 of the legs 104 so as to pivot the latter radially outwardly (with reference to the axis of the bearing element 51) against the opposition of the respective torsion springs 109. This causes the convex surfaces 129 of the legs 104 to engage the internal surface of the core 17 in order to bring about a preliminary centering of the respective bobbin 6.

The roller followers 112 thereupon advance against the rear cam faces 131 of the respective legs 107 which are spread radially outwardly against the opposition of the respective torsion springs 111 whereby the hook-shaped pallets of the legs 107 engage the core 17 and urge it axially against the axial stop 52 of the bearing element 51. The roller followers 112 transmit an additional radial force which causes the bobbin 6 to assume its final position with reference to the receiver 46, as considered in the radial direction of the bearing element 51.

In order to allow for ejection of an expired bobbin 6, the piston 122 is acted upon by compressed air which is admitted via port 121 of the actuating device 42 so that the pusher 113 is retracted against the opposition of the coil spring 114. This causes the roller followers 112 to act upon the legs 104, 107 of the respective jaws 47 in a sense to become disengaged from the core 17 under the action of the respective prestressed torsion springs 109, 111 so that the core 17 is released and can leave the station 44 by gravity. The piston 122 is actuated in such a way that an outer edge face 132 of the pusher 113 bears against an inner edge face 133 of the bearing element 51 (actually of the adjusting member 108 which mates with the bearing element 51) whereby the piston 122 performs an overstroke to shift the bearing element 51 through a short distance axially against the opposition of the dished spring 124 to such an extent that the axial stop 52 of the bearing element 51 cannot interfere with further progress of the bobbin changing operation.

The provision of spindles 9 and 11 whose components can be retracted into the holder 8 preparatory to indexing of the holder exhibits the important advantage that a retracted spindle cannot interfere with the travel of a running web from the bobbin on the other spindle while the holder 8 is pivoted by the motor 5 to move the empty (retracted) spindle from the web dispensing station 44 to the receiving station 19.

A support which embodies the structure of FIG. 7 exhibits the advantage that its compactness exceeds even that of the support which is shown in FIG. 4 because the actuating means for the pushers 113 of the two spindles can be mounted directly on the respective core receivers 46. Moreover, the sleeves 48 and the rods 49 can be replaced with relatively simple and compact pushers 113 and the composite bobbin-engaging elements 47 of FIG. 7 can be articulately connected directly to the bearing element 51. The support of FIG. 7 further exhibits the aforediscussed advantage that the spindles can accept bobbins having relatively short, medium long or long cores, i.e., that such spindles can carry bobbins having relatively wide or narrow webs, depending on the diameters of rod-shaped articles which are to be turned out by the associated consuming machine.

The improved bobbin manipulating apparatus can be installed in or combined with existing machines for the making of plain or filter cigarettes, filter rod sections or like rod-shaped articles as a superior substitute for heretofore known bobbin changing apparatus. The apparatus can be transferred from one consuming machine to another because it need not be positively coupled to the consuming machine.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for manipulating bobbins having cores for convoluted webs, such as webs of cigarette paper, comprising a magazine arranged to store a supply of bobbins and comprising means for maintaining the axes of the supply of bobbins therein in positions of coincidence with or at least close to a first predetermined axis; a support; and means for transferring discrete bobbins from said magazine to said support, comprising a gripping device having means for engaging the peripheries of discrete bobbins and means for moving said device between said magazine and said support, said support including means for receiving and retaining the core of the bobbin which is delivered by said gripping device and said gripping device comprising tongs constituting an at least substantially complete annulus defining a central opening for the bobbin which is being transferred to said support, said receiving means defining a second axis and said moving means including means for locating said tongs and said magazine in a position of at least substantial concentricity with the bobbin awaiting transfer to said support, said moving means further comprising means for changing the orientation of said gripping device during transfer of bobbins to said support so that the axis of the bobbin which reaches said receiving means coincides with or is at least close to said second axis, said orientation changing means including means for pivoting said gripping device about a third axis which is inclined with reference to said first and second axes, one of said first and second axes being horizontal, the other of said first and second axes being vertical and said third axis being normal to said first and second axes.

2. The apparatus of claim 1, wherein said first axis is vertical.

3. The apparatus of claim 1, wherein said pivoting means comprises a crank drive.

4. The apparatus of claim 1, wherein said tongs have a carrier and said engaging means includes an annulus of neighboring bobbin engaging elements on said carrier, said gripping device further including means for jointly displacing said elements relative to said carrier into and from engagement with the periphery of a bobbin which is surrounded by said annulus.

5. The apparatus of claim 4, wherein said displacing means comprises means for articulately connecting the neighboring elements to each other and motor means for pivoting one of said elements so that the other elements are pivoted by way of said connecting means.

6. The apparatus of claim 1 for manipulating bobbins having cores for convoluted webs, wherein said receiving means comprises at least one spindle having a core retainer and actuating means for moving the retainer into and from engagement with the core of a bobbin which is transferred from said magazine by said gripping device.

7. The apparatus of claim 6, wherein said core retainer comprises a plurality of mobile clamping elements and means for shifting said clamping elements into and from radial and axial engagement with the core of a transferred bobbin in response to operation of said actuating means.

8. The apparatus of claim 7, wherein said shifting means comprises a rotary bearing element and means for movably securing said clamping elements to said bearing element.

9. The apparatus of claim 8, wherein said bearing element comprises an axial stop for the core of a bobbin.

10. The apparatus of claim 8, wherein said means for movably securing said clamping elements to said bearing element comprises a first axially movable shifting member in said bearing element, a second axially movable shifting member in said first shifting member, and means for articulately connecting each of said clamping elements to said first and second shifting members.

11. The apparatus of claim 10, wherein said means for articulately connecting comprises pivot means for attaching said clamping elements to one of said shifting members and links for attaching said clamping elements to the other of said shifting members.

12. The apparatus of claim 8, wherein each of said clamping elements includes a pair of legs and means for pivotally coupling said legs to each other, said means for movably securing said clamping elements to said bearing element comprising means for pivotally connecting one leg of each of said clamping elements directly to said bearing element.

13. The apparatus of claim 12, wherein said actuating means comprises a pusher axially movably mounted in said core retainer and having follower means adjacent to the legs of said clamping elements and means for reciprocating said pusher to thereby pivot the legs of said clamping elements relative to the core of a bobbin in response to axial movement of said pusher.

14. The apparatus of claim 13, wherein said actuating means is mounted directly on said core retainer.

15. The apparatus of claim 13, wherein said means for reciprocating said pusher comprises a spring for biasing said pusher axially in a first direction and a fluid-operated motor for moving said pusher axially in a second direction counter to said first direction.

16. The apparatus of claim 15, wherein said spring is arranged to bias said pusher in a direction to effect a movement of at least one leg of each clamping element into engagement with the core of a bobbin.

17. The apparatus of claim 13, wherein said actuating means further comprises resilient means for biasing said pusher in a first direction so as to disengage said clamping elements from the core of a bobbin and a motor for moving said pusher axially in a second direction so as to move said bearing element axially and away from the core of a bobbin.

18. The apparatus of claim 12, further comprising discrete springs for biasing the legs of said clamping elements in directions to disengage said clamping elements from the core of a bobbin.

19. The apparatus of claim 8, wherein said bearing element comprises an axial stop and means for adjusting said clamping elements with reference to said stop so that said stop and said clamping elements can cooperate to engage and retain cores having different axial lengths.

20. The apparatus of claim 19, wherein said bearing element comprises a main portion which includes said stop and said adjusting means comprises a second portion which is threadedly connected to said main portion and carries said clamping elements.

21. Apparatus for manipulating bobbins having cores for convoluted webs, such as webs of cigarette paper, comprising a magazine arranged to store a supply of bobbins and comprising means for maintaining the axes of the supply of bobbins therein in positions of coincidence with or at least close to a substantially vertical first axis; a support; means for transferring discrete bobbins from said magazine to said support, comprising a gripping device having means for engaging the peripheries of discrete bobbins and means for moving said gripping device between said magazine and said support, said support including means for receiving and retaining the core of the bobbin which is delivered by said gripping device and said gripping device comprising tongs constituting an at least substantially complete annulus defining a central opening for the bobbin which is being transferred to said support, said receiving means defining a second axis and said moving means including means for locating said tongs and said magazine in a position of at least substantial concentricity with the bobbin awaiting transfer to said support, said moving means further comprising means for changing the orientation of said gripping device during transfer of bobbins to said support so that the axis of the bobbin which reaches said receiving means coincides with or is at least close to said second axis; and elevator means for reciprocating said gripping device along a path extending in substantial parallelism with said first axis.

22. The apparatus of claim 21, wherein said elevator means is arranged to move said gripping device to a predetermined uppermost position and said orientation changing means is operative to change the orientation of said tongs during transfer between said predetermined position and a second position in which the axis of the bobbin on said gripping device coincides with said second axis.

* * * * *